US006842972B2

(12) United States Patent
Araki

(10) Patent No.: US 6,842,972 B2
(45) Date of Patent: Jan. 18, 2005

(54) APPARATUS FOR JOINING TERMINALS

(75) Inventor: Yoshihiro Araki, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/354,030

(22) Filed: Jan. 30, 2003

(65) Prior Publication Data

US 2003/0150105 A1 Aug. 14, 2003

(30) Foreign Application Priority Data

Feb. 12, 2002 (JP) ..... 2002-033803

(51) Int. Cl.[7] ..... H01B 43/00
(52) U.S. Cl. ..... 29/748; 29/857; 29/861
(58) Field of Search ..... 29/748, 857, 861, 29/825

(56) References Cited

FOREIGN PATENT DOCUMENTS

JP 2000-68022 3/2000

*Primary Examiner*—Carl J. Arbes
(74) *Attorney, Agent, or Firm*—Greenblum & Berstein, P.L.C.

(57) ABSTRACT

A terminal-joining apparatus includes a lock member. A temporarily assembled unit of a terminal assembly is guided into a receiving space and a bent portion of the unit pushes up a releasing surface of the lock member. When the releasing surface is pushed up, the lock member is turned about a fixed axle and a lock-supporting portion is moved down. When a lever is released from the lock-supporting portion and is turned about an axle, the temporarily assembled unit of the terminal assembly is pressed between a pressing surface and a stop wall to permanently join the unit.

10 Claims, 10 Drawing Sheets

APPARATUS FOR JOINING TERMINALS

BACKGROUND OF THE INVENTION

1. Field of the Invention

This invention relates to an apparatus for joining terminals and more particularly relates to a terminal joining apparatus for permanently joining a temporarily assembled unit in which connecting portions of plural terminals are displaced from and stacked on each other.

For example, in the case where electric wires for a ground cable to be used in a wire harness in an automobile are connected to a ground stud bolt mounted on a vehicle body, a terminal connected to each end of a plurality of electric wires is not inserted into the stud bolt individually. A unit in which the respective terminals are joined together is inserted into the stud bolt by one step, thereby enhancing an efficiency of work.

Each of the ground terminals includes an annular connecting portion having a through-hole to be inserted into the stud bolt, and a barrel portion extending from the connecting portion. The ground terminals are stacked on each other with the connecting portions being displaced from each other to form a temporarily assembled unit. The unit is permanently joined by driving the unit in directions perpendicular to the axes of the barrel portions.

2. Description of the Prior Art

In order to facilitate joining ground terminals, an assignee of the present application has proposed an auxiliary device for coupling two ground terminals (Japanese Patent Public Disclosure No. 2000-068022).

In the auxiliary device for coupling disclosed in the reference, the through-hole in each of the ground terminals in a temporarily assembled condition is enlarged by inserting a tapered coupling tool into the through-hole. The ground terminals are stacked on each other so that the through-holes are aligned on the same axis and then joined permanently together. At this time, the barrel portions of the respective ground terminals extend on a single line with the phases in the circumferential direction being coincident with each other.

The auxiliary device described above is very effective for joining two ground terminals. However, in the case of joining more than three ground terminals, they may be incorrectly assembled with the phases of the barrel portions being inverted in the circumferential direction. In this case, the assembled dimensions or some other feature of the assembly of the ground terminals does not meet the designed specification and this causes the assembly not to be able to be mounted on a component.

When there are more than three ground terminals, the above auxiliary device requires dividing the ground terminals into several groups with each having two ground terminals.

SUMMARY OF THE INVENTION

In view of the above problems, an object of the present invention is to provide a terminal joining apparatus for joining ground terminals in multiple layers with an efficient operation and no errors.

In order to solve the above problems, the present invention provides an apparatus for joining a plurality of ground terminals, wherein each of the ground terminals includes a plate-like or planar connecting portion and a barrel portion extending from the connecting portion, the connecting portions are displaced from and stacked on each other to form a temporarily assembled unit, and the unit is permanently joined by driving the unit in a direction perpendicular to the axes of the barrel portions. The apparatus comprises a receiving space for guiding a temporarily assembled unit, in which the respective connecting portions are assembled beforehand in a temporarily joined condition, along a longitudinal direction of the barrel portions; one of a pair of dies adjacent to the receiving space for receiving one of the side sections of the temporarily assembled unit; the other of the pair of dies for regularly or permanently joining the respective ground terminals temporarily assembled by pressing the temporarily assembled unit in cooperation with the one die; a driving mechanism for driving the pair of dies between an open position where the temporarily assembled unit is allowed to enter a space between the dies and a pressing position where the unit is pressed; a locking mechanism for restraining the driving mechanism in the open position; and a lock-releasing mechanism for releasing the locking mechanism only when the temporarily assembled unit guided in the receiving space stacks the ground terminals in a predetermined stacking condition.

According to the present invention, since the terminal-joining apparatus includes the lock-releasing mechanism, only a temporarily assembled unit of ground terminals stacked in a proper condition can release the locking mechanism. The ground terminals guided into the receiving space are permanently joined by driving the dies by means of the driving mechanism in the condition released from locking. Accordingly, a worker can actuate the driving mechanism only when the temporarily assembled ground terminals in a regularly or properly stacked condition are inserted into the receiving space, thereby eliminating a problem in which a temporarily incorrectly assembled unit, in which the phases of the respective ground terminals are inverted, is permanently joined.

Since the lock-releasing mechanism is suitable for a stacked condition of more than three ground terminals, it is possible for the terminal-joining apparatus to carry out a permanent assembly operation in only one step, whereas two steps were required in the prior art.

An aspect of the present invention provides an apparatus for joining a plurality of ground terminals, wherein each of the ground terminals includes a planar connecting portion and a barrel portion extending from the connecting portion, the connecting portions are displaced from and stacked on each other to form a temporarily assembled unit, the apparatus including a receiving space for guiding a temporarily assembled unit along a longitudinal direction of the barrel portions; a first of a pair of dies defining the receiving space, the first die receiving a side section of the temporarily assembled unit; a second of the pair of dies defining the receiving space, the second die permanently joining the temporarily assembled ground terminals by pressing the temporarily assembled unit in cooperation with the first die; a driving mechanism that drives the pair of dies between an open position wherein the temporarily assembled unit can enter a space between the dies and a pressing position wherein the unit is pressed, wherein the unit is permanently joined by driving the ground terminals of the unit in directions perpendicular to the axes of the barrel portions; a locking mechanism that restrains the driving mechanism in the open position; and a lock-releasing mechanism that releases the locking mechanism only when the temporarily assembled unit guided in the receiving space includes the ground terminals stacked in a predetermined stacking configuration.

According to a further aspect of the present invention, the lock-releasing mechanism prevents release of the locking mechanism when the temporarily assembled unit guided in the receiving space includes the ground terminals stacked in a stacking configuration other than the predetermined stacking configuration.

In a further aspect of the present invention, the driving mechanism includes a driving base; a lever rotatably mounted on the driving base; a guide tube provided on the driving base; a drive shaft secured to the lever and slidably moveable in the guide tube; and a screw member secured to the drive shaft and to the second die such that upon rotation of the lever the drive shaft slides within the guide tube, driving the second die toward the first die and permanently joining the temporarily assembled unit. The apparatus may further include an inspection unit including an inspection probe provided on the driving base and a pushing projection provided on the lever, wherein when the lever is fully rotated to a down position and the second die is fully driven toward the first die, the inspection unit signals an operator that the temporarily assembled unit is permanently joined.

According to a further aspect of the present invention, the locking mechanism may include a nut provided on the screw member; a locking member rotatably mounted on the first die, the locking member having an elongated configuration and including a lock releasing portion provided at a front end thereof and a lock supporting portion provided at a rear end thereof and cooperating with the nut; and a guide groove provided in the receiving space, the guide groove configured to receive a bent connecting portion of the lowermost ground terminal; wherein when a temporarily assembled unit is guided along the longitudinal direction of the barrel portions into the receiving space, the bent connecting portion is guided along the guide groove to a position in which the bent connecting portion contacts the lock releasing portion and releases the lock mechanism by rotating the locking member until the lock supporting portion is released from the nut and freeing the driving mechanism. Further, when a temporarily assembled unit that includes the ground terminals stacked in a stacking configuration other than the predetermined stacking configuration is guided along the longitudinal direction of the barrel portions into the receiving space, at least one of the barrel portions prevents the bent connecting portion from being guided along the guide groove to the position in which the bent connecting portion contacts the lock releasing portion and the locking mechanism remains locked, preventing permanent joining of the temporarily assembled unit.

According to a further aspect of the present invention, the locking mechanism may include a locking arm provided on the drive shaft; and a locking member rotatably mounted on the first die, the locking member having an elongated configuration and including a lock releasing portion provided at a front end thereof and a lock supporting portion provided at a middle portion thereof and cooperating with the locking arm. When a temporarily assembled unit is inserted into the receiving space it engages the lock releasing portion, whereby the locking member is rotated until the lock supporting portion is released from the locking arm freeing the driving mechanism. Further, when a temporarily assembled unit that includes the ground terminals stacked in a stacking configuration other than the predetermined stacking configuration is inserted into the receiving space, the locking member is not rotated and the supporting portion engages the locking arm so that the locking mechanism remains locked, preventing permanent joining of the temporarily assembled unit. Further, the barrel portions of a temporarily assembled unit inserted into the receiving space engage the lock releasing portion for rotating the locking member. The locking member further includes an adjustment portion provided at a rear end thereof for limiting rotation of the locking member in order to adjust a position of the lock releasing portion.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE PREFERRED EMBODIMENTS

Figure 1:
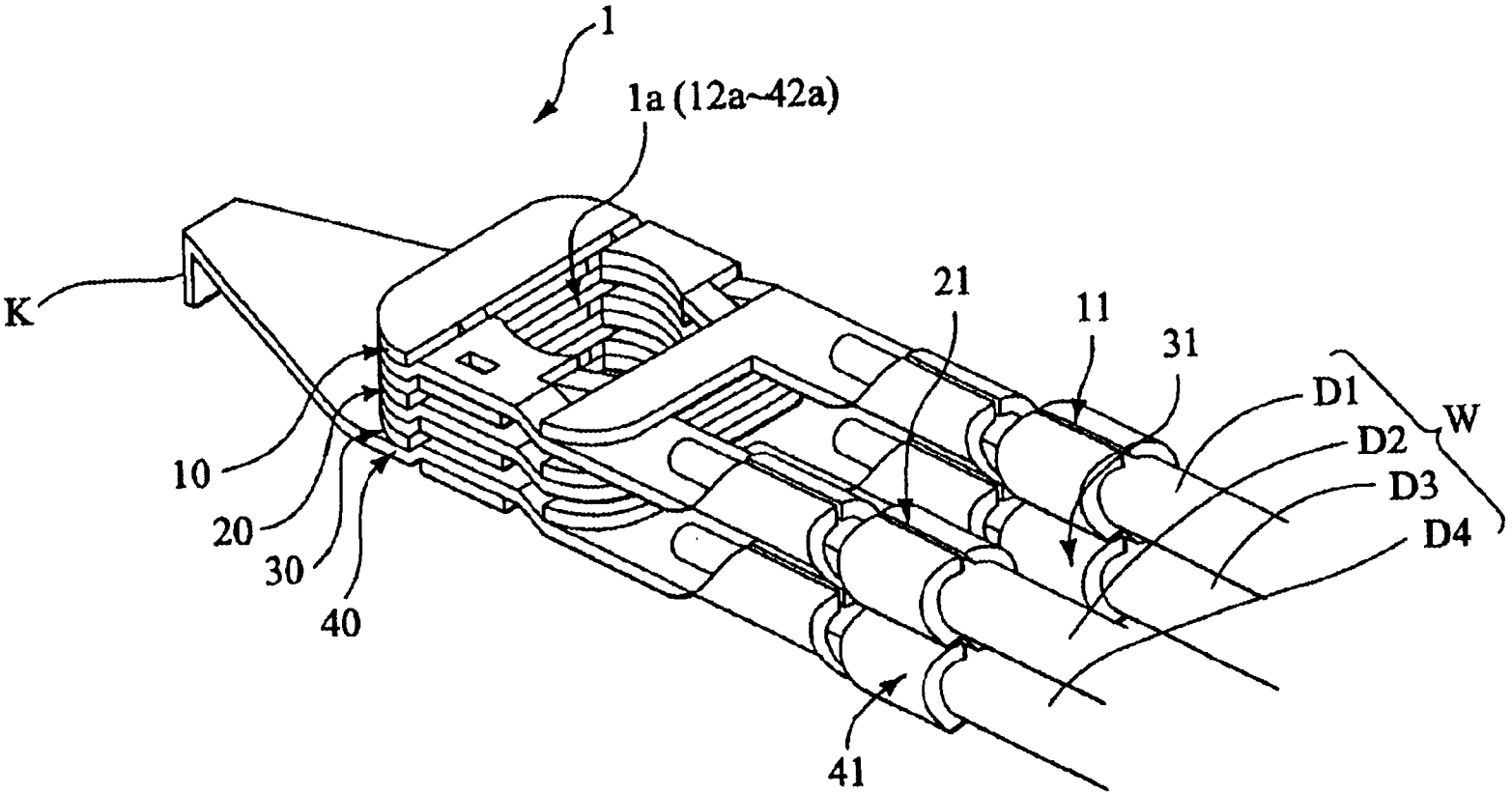
FIG. 1 is a perspective view of a terminal assembly to which an embodiment of the present invention is applied.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

By referring now to the drawings, a preferred embodiment of an apparatus for joining terminals (a terminal-joining apparatus) in accordance with the present invention will be described below.

Figure 2:
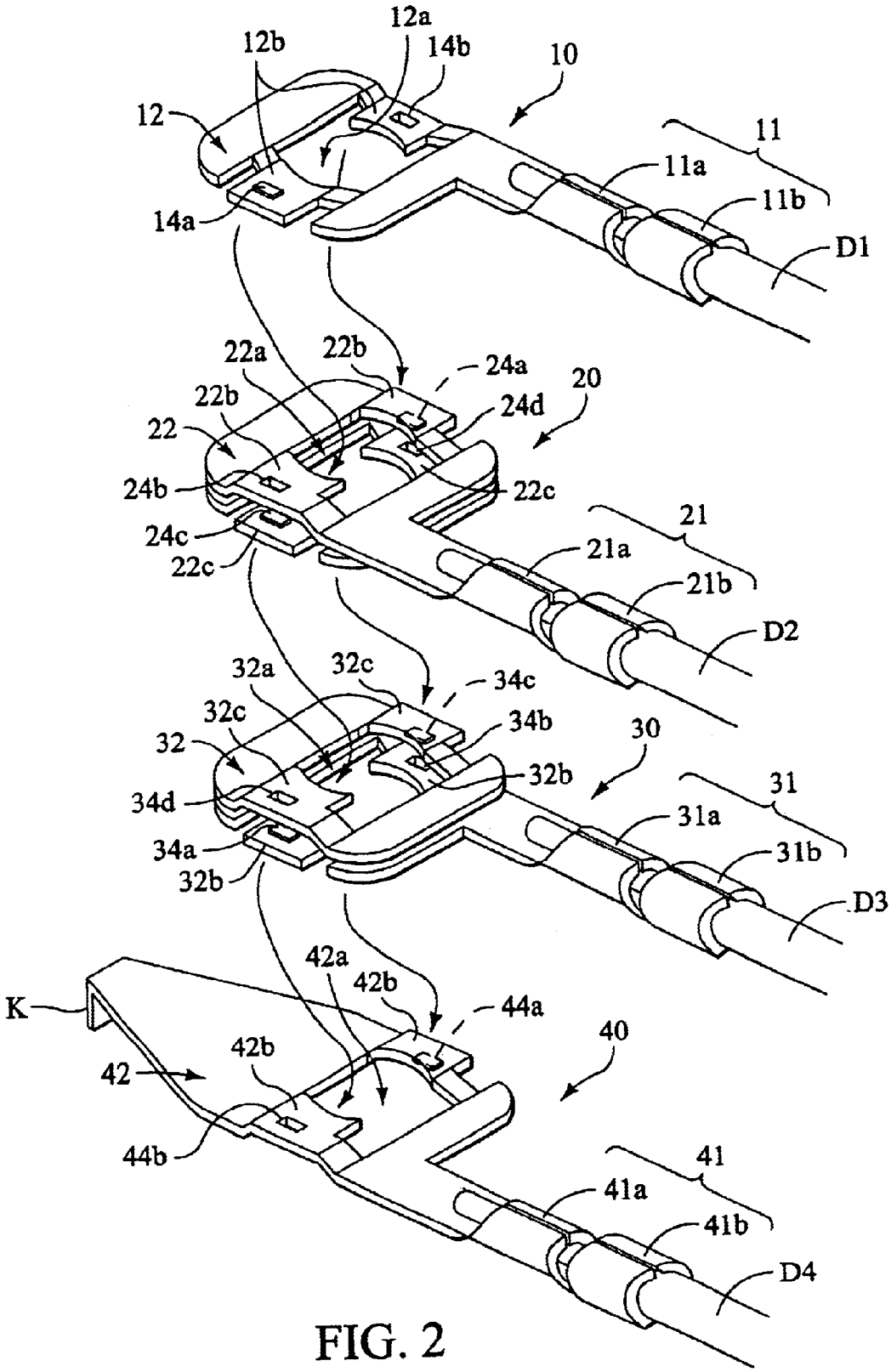
FIG. 2 is an exploded perspective view of the terminal assembly shown in FIG. 1, illustrating the assembly in a proper assembling position.

FIG. 1 is a perspective view of a terminal assembly 1 to which an embodiment in accordance with the present invention is applied. FIG. 2 is an exploded perspective view of the terminal assembly 1 shown in FIG. 1, illustrating the assembly in a regular assembling position.

Referring to FIGS. 1 and 2, the terminal assembly 1 includes four kinds of ground terminals 10, 20, 30, and 40 that are interconnected as shown in FIG. 1. The terminals 10, 20, 30, 40 are stacked in a particular order (in the illustrated embodiment, the terminals 10, 20, 30, and 40 are stacked downwardly, respectively). The respective terminals 10, 20, 30, and 40 are made of a conductive material and have barrel portions 11, 21, 31, and 41 that are adapted to be crimped onto electric wires W and connecting portions 12, 22, 32, and 42 that are coupled to the barrel portions 11, 21, 31, 41, respectively.

The respective barrel portions 11, 21, 31, 41 of the respective ground terminals 10, 20, 30, 40 include core element barrels 11*a*, 21*a*, 31*a*, 41*a* and sheath barrels 11*b*, 21*b*, 31*b*, 41*b*, as well known in the art. These components are crimped on stripped ends of sheathed electric wires D1, D2, D3, D4. In the above stacked order of the respective barrel portions 11, 21, 31, 41 of the respective ground terminals 10, 20, 30, 40, the barrel portions 11 and 31 of the odd numbered terminals 10 and 30 (i.e., the first and third terminals) are displaced to the right side in the plan view of FIG. 2 while the barrel portions 21 and 41 of the even numbered terminals 20, 40 (i.e., the second and third terminals) are displaced to the left side in the plan view of FIG. 2. The present invention is not limited to four terminals as is shown in the figures and may include any number of terminals. In such embodiments having greater than four terminals, the barrel portion of each additional odd numbered terminal (i.e., a fifth terminal, a seventh terminal, etc.) would be displaced to the right as shown in FIG. 2 and the barrel portion of each additional even numbered terminal (i.e., a sixth terminal, an eighth terminal, etc.) would be displaced to the left as shown in FIG. 2.

The respective connecting portions 12, 22, 32, 42 of the respective ground terminals 10, 20, 30, 40 are formed into planar configurations extending from core element barrels 11*a*, 21*a*, 31*a*, 41*a* and are provided with fitting apertures 12*a*, 22*a*, 32*a*, 42*a* adapted to receive a stud bolt or a terminal (not shown). The fitting apertures 12*a*, 22*a*, 32*a*, 42*a* are aligned on the same axis to define a common aperture 1*a* (see FIG. 1) when the respective ground terminals 10, 20, 30, 40 are assembled.

In order to stack and interconnect the connecting portions 12, 22, 32, 42 with these fitting apertures 12*a*, 22*a*, 32*a*, 42*a* being coaxially aligned, the connecting portions 12, 22, 32, 42 are provided with pairs of tongue pieces 12*b*, 22*b*, 32*b*, 42*b* that extend perpendicularly to the barrel portions 11, 21, 31, 41, respectively, and extend radially in the fitting apertures. Further, as shown in FIG. 2, the tongue pieces 12*b*, 22*b*, 32*b*, 42*b* extend away from the respective barrel portions 11, 21, 31, 41 (e.g., as shown in FIG. 2, the barrel portion 11 is displaced to the right and the tongue pieces 12*b* extend toward the left). In the order of the stacked ground terminals 10, 20, 30, 40, the tongue pieces on the odd numbered layers (i.e., the first and third layers) are recessed while the tongue pieces on the even numbered layers (i.e., the second and fourth layers) are raised. The upper sides of tongue pieces 12*b* and 32*b* face the lower sides of tongue pieces 22*b* and 42*b*, respectively, while the lower sides of tongue pieces 22*b* and 42*b* face the upper sides of tongue pieces 12*b* and 32*b*, respectively. Consequently, it is possible to stack the upper layer tongue pieces 12*b* and 32*b* on the lower layer tongue pieces 22*b* and 42*b* in a symmetrical manner with respect to a horizontal direction to couple the connecting portions with each other. Pairs of tongue pieces 22*c* and 32*c* of the ground terminals 20 and 30, respectively, are provided to be coupled to the upper and lower middle ground terminals (to each other) according to the same principal and in the same manner. The tongue pieces 22*c* and 32*c* project radially toward the barrel portions 21 and 31. Further, latch projections 14*a*, 24*a*, 34*a*, 44*a*, and 24*c* and 34*c* are formed on certain of the respective tongue pieces while latch holes 14*b*, 24*b*, 34*b*, 44*b*, and 24*d* and 34*d* are formed on the other respective tongue pieces. Upon connection, the respective ground terminals 10, 20, 30, 40 are coupled to each other, as shown in FIG. 1, by engaging the latch projections 14*a*, 24*a*, 34*a*, 44*a*, 24*c*, and 34*c* with the respective mating latch holes 14*b*, 24*b*, 34*b*, 44*b*, 24*d*, and 34*d*.

Also, in the illustrated embodiment, the terminal 40 stacked on the lowermost layer includes a bent rectangular portion K on the distal end.

In a process of permanently joining the respective ground terminals 10, 20, 30, 40, the latch projections 14*a*, 24*a*, 34*a*, 44*a*, 24*c*, and 34*c* do not reach the mating latch holes 14*b*, 24*b*, 34*b*, 44*b*, 24*d*, and 34*d* to form a temporarily assembled unit while the tongue pieces 12*b*, 22*b*, 32*b*, 42*b*, 22*c*, and 32*c* engage the tongue pieces of the mating terminals, and then the terminal-joining apparatus 50 in the embodiment of the present invention permanently joins the temporarily assembled unit.

In an embodiment in which the specifications of the tongue pieces 22*c* and 32*c* for intermediate coupling provided on the ground terminals 20 and 30 on intermediate layers is the same as that of the other tongue pieces 12*b*, 22*b*, 32*b*, 42*b*, only the projecting direction of the former is different from that of the latter. Thus, as shown in FIG. 3, the ground terminals 20 and 30 may be assembled incorrectly in an inverted manner.

Figure 3:
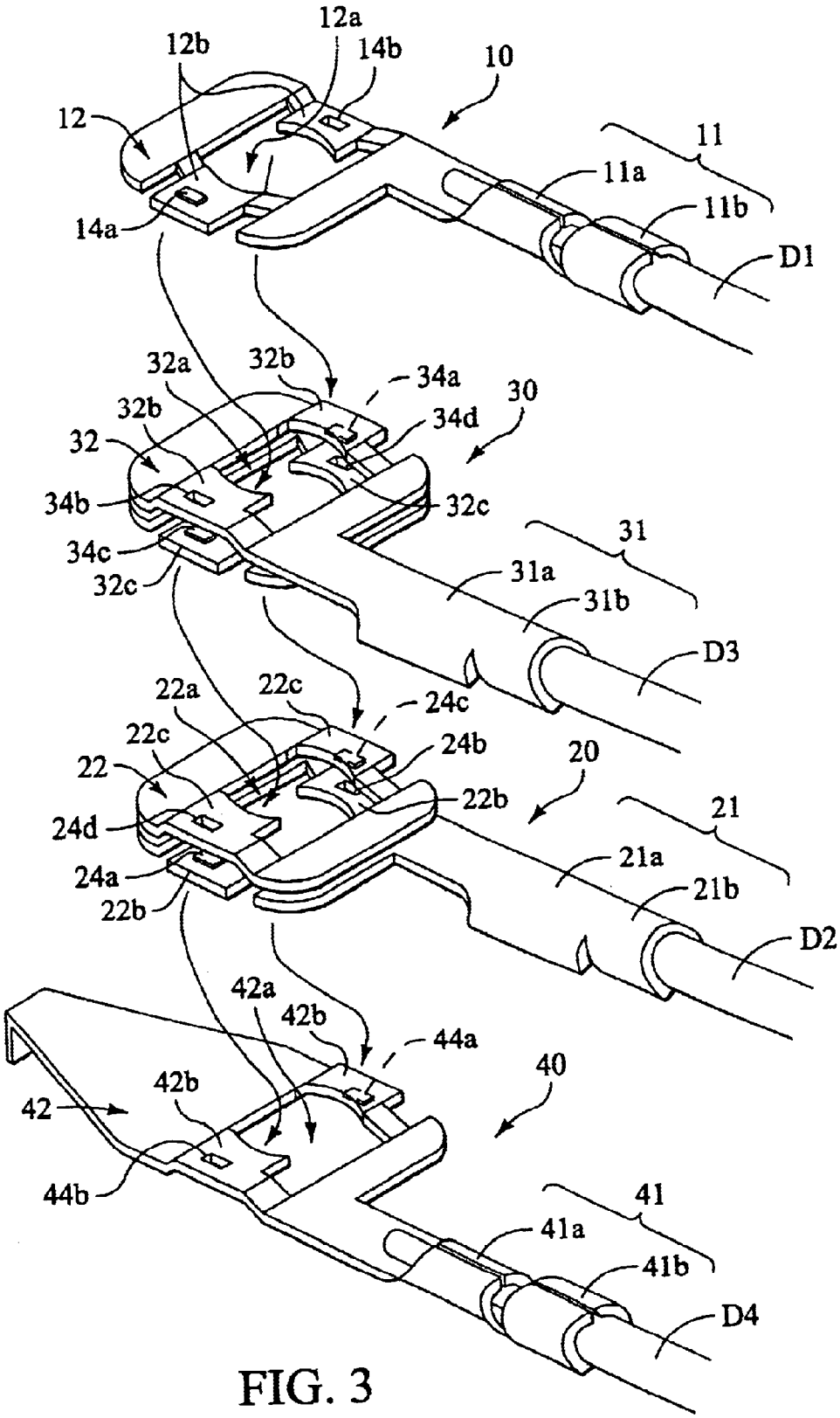
FIG. 3 is an exploded perspective view of the terminal assembly shown in FIG. 1, illustrating the assembly in another assembling position.

FIG. 3 is an exploded perspective view of the terminal assembly 1 shown in FIG. 1, illustrating the assembly in another assembling position.

Referring now to FIGS. 2 and 3, the ground terminal 30, the right side of which is reversed to the back side (i.e., the ground terminal 30 is inverted) has the same structure as that of the ground terminal 20, except for the barrel portion 21 being displaced in the opposite direction, in comparison with the regularly assembled position. In the state shown in FIG. 3, the reversed ground terminals 20 and 30 direct the respective barrel portions 21 and 31 downward. Thus, even if the ground terminal 20 is exchanged for the ground terminal 30 except for the postures of the barrel portions 21 and 31, they may be assembled by a manner similar to the regular assembling method. In this case, the external dimensions of the final assembly is different from the external dimensions of the final assembly as designed and the terminal assembly may not be mounted on a predetermined component. Accordingly, the terminal-joining apparatus 50 described hereinafter includes a mechanism for preventing the ground terminals 10, 20, 30, 40 that are incorrectly temporarily assembled by such a mistake from being regularly assembled. A terminal assembly that is constructed by the above assembling condition is hereinafter referred to as "a terminal assembly 2".

An apparatus 50 for joining terminals (a terminal-joining apparatus 50) that interconnects the ground terminals 10, 20, 30, 40 described above with an efficient operation and no errors will be described below by referring to the drawings.

Figure 4:
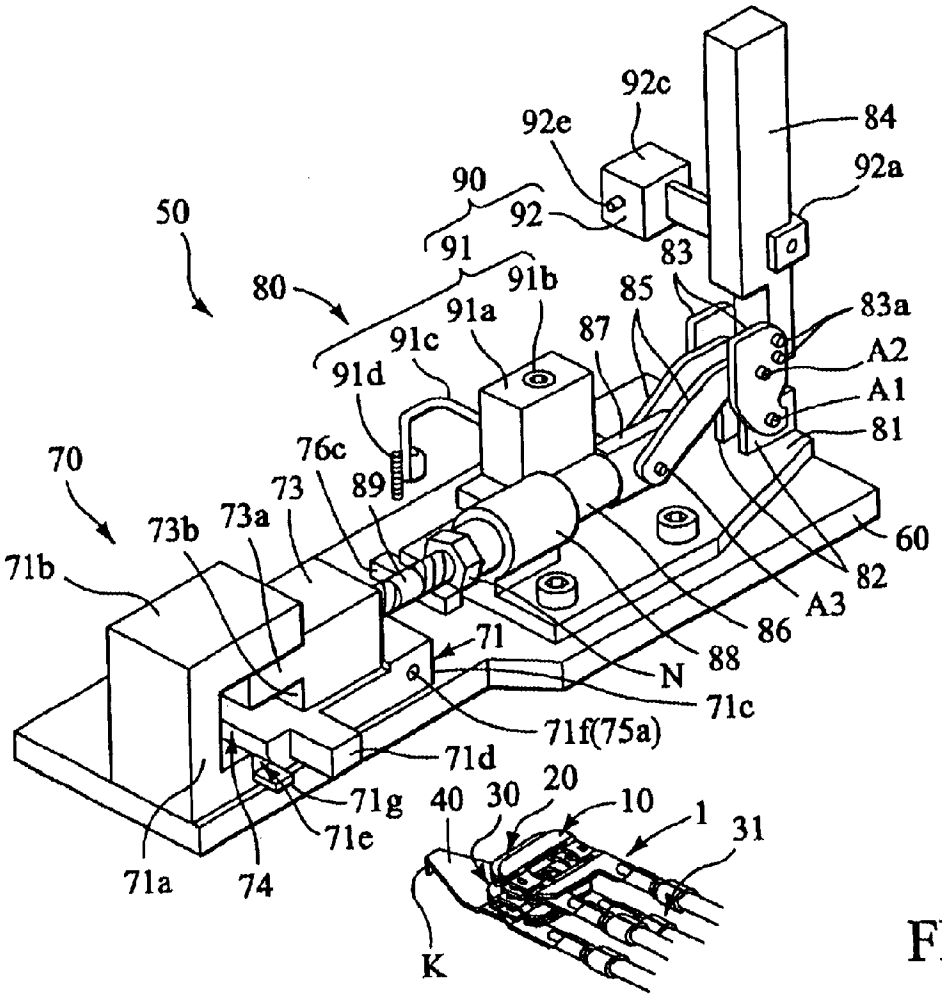
FIG. 4 is a perspective view of an embodiment of an apparatus for joining terminals in accordance with the present invention.
Figure 5:
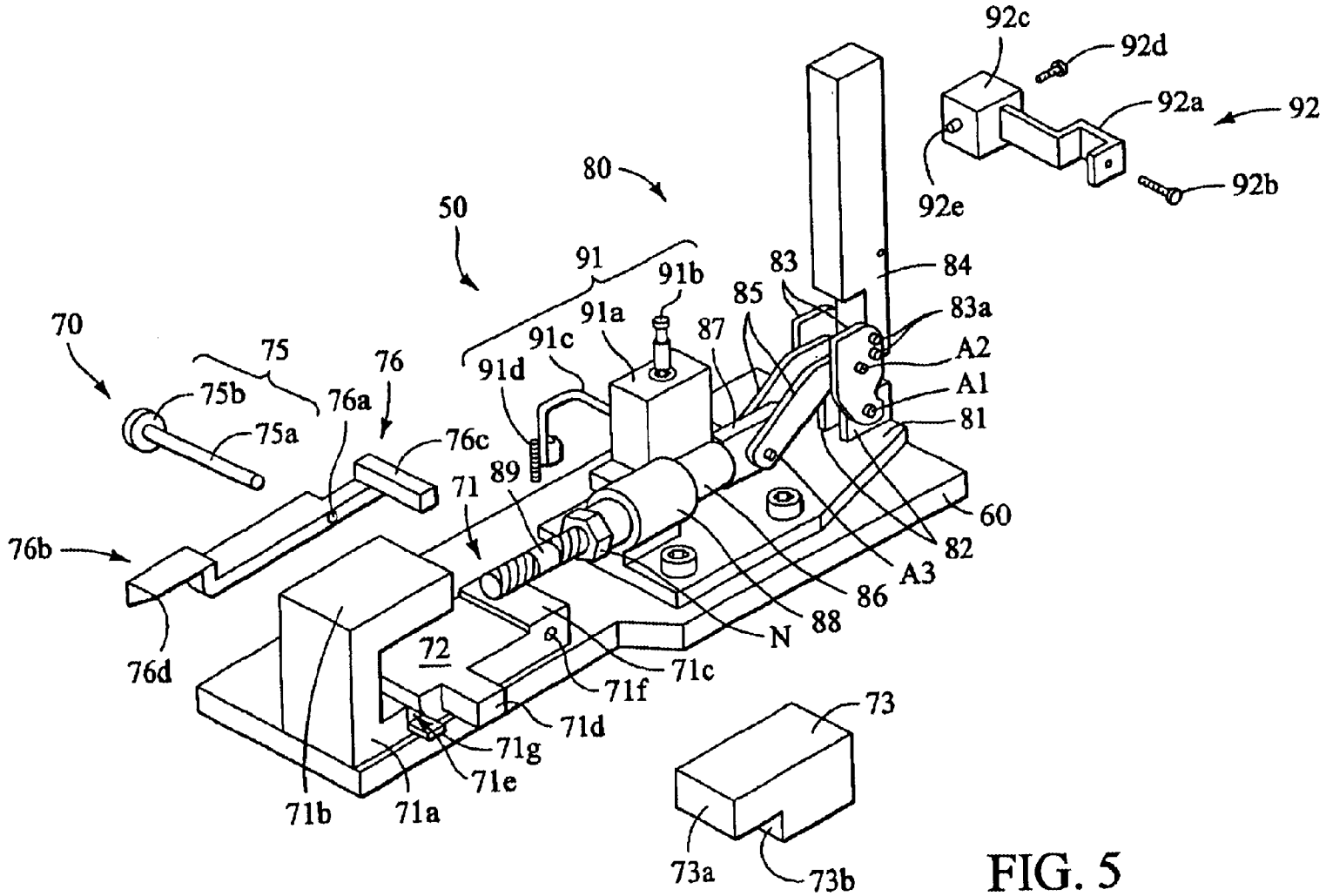
FIG. 5 is an exploded perspective view of the terminal-joining apparatus shown in FIG. 4.

FIG. 4 is a perspective view of an embodiment of the terminal-joining apparatus 50 in accordance with the present invention. FIG. 5 is an exploded perspective view of the terminal-joining apparatus 50 shown in FIG. 4.

Referring to FIGS. 4 and 5, the terminal-joining apparatus 50 includes a base 60. The base 60 may be constructed of any suitable material such as, for example, metallic material, and is formed into a rectangular parallelepiped member. The base 60 is provided on an end with a holder 70 that holds a temporarily assembled unit of the terminal assembly 1 and on the other end with a driving mechanism 80. For convenience of explanation, the end of the base 60, on which the holder 70 is provided, is hereinafter referred to as the front side and the surface of the base 60, on which the holder 70 is mounted, is hereinafter referred to as the upper side in the thickness direction of the base 60.

The holder 70 includes a planar holder base 71, which may be constructed of any suitable material such as, for example, metallic material. The holder base comprises a stop wall 71*a* that stands upright on the front end and serves as one of a pair of dies, and a top wall 71*b* that extends horizontally from the upper end of the stop wall 71*a* so as to be spaced away from the holder base 71. In addition, the holder base 71 is provided on the rear side end with an opposed wall 71*c* that extends upwardly. The stop wall 71*a*, top wall 71*b*, and opposed wall 71*c* define a containing space 72. A driving and pressing block 73 is slidably disposed in the containing space 72 and serves as the other of the pair of dies. The driving and pressing block 73 is formed into a substantially rectangular parallelepiped member. The driving and pressing block 73 is provided on the front end thereof with a projection 73*a* that projects forward. The driving and pressing block 73 is also provided on the front end surface with a non-projecting portion having a pressing surface 73*b*. The driving and pressing block 73 is accommodated in the containing space 72 with the pressing block 73 contacting the holder base 71 and top wall 71*b*. The pressing block 73 can be driven between the stop wall 71*a* and the opposed wall 71*c*. Thus, when the driving and pressing block 73 is accommodated in the containing space 72, a receiving space 74 is defined by the pressing surface 73*b*, holder base 71, projecting portion 73*a*, and stop wall 71*a*. The height of the receiving space 74 is set to be substantially the same as a thickness of the temporarily assembled unit of the terminal assembly 1. The holder base 71 is provided in a position corresponding to the barrel portion 31 of the ground terminal 30 of the temporarily assembled unit to be guided into the receiving space with an inspecting portion 71*d* that extends in the width direction of the holder base 71. Furthermore, the holder base 71 is provided with a guiding groove 71*e* for guiding the bent portion K of the terminal assembly 1. The guiding groove 71*e* is provided on each of its opposite ends with groove tongue 71*g* (only one of which is shown in FIGS. 4 and 5) that extends from the bottom surface of the guiding groove 71*e*.

In addition, the holder base 71 is provided near the end in the width direction thereof with a supporting hole 71*f*. A fixing axle 75 is forcedly inserted into the supporting hole 71*f*. The fixing axle 75 may be constructed of any suitable material such as, for example, metallic material, and includes an axle body 75*a* and a fixing flange 75*b*. The axle body 75*a* is rotatably passed through a bearing hole 76*a* in a lock member 76 and is forcedly inserted into the supporting hole 71*f*. Under this condition, the fixing flange 75*b* serves to prevent the lock member 76 from coming out from the holder base 71. The lock member 76 is formed into an extended bar shaped member and may be constructed of any suitable material such as, for example, metallic material. The lock member 76 is provided on the front end thereof with a lock-releasing portion 76*b* and on the rear end thereof with a lock-supporting portion 76*c*. The lock-releasing portion 76*b* is provided with a releasing surface 76*d* extending diagonally toward the right side, in the front elevation view. The releasing surface 76*d* is disposed on the groove piece 71*g* so that the releasing surface 76*d* closes an opening of the guiding groove 71*e*, as seen in the side elevation view. The lock-supporting portion 76*c* extends toward the holder 70 in a direction perpendicular to the lock member 76. The lock-supporting portion 76*c* is disposed slightly toward the front side of a nut N described below.

The driving mechanism 80 includes a driving base 81. The driving base 81 is provided on the rear end thereof with a pair of supporting portions 82 standing on the driving base 81. An axle A1 rotatably supports a joining plate 83 on each supporting portion 82. A lever 84 is secured to and between the joining plates 83 by bolts 83*a* while a pair of movable plates 85 are rotatably supported between the joining plates 83 by an axle A2. A connecting plate 87 integrated with a driving shaft 86 is rotatably supported on and between the movable plates 85 by an axle A3. The driving shaft 86 is slidably inserted into a guiding hole 88 in the front end of the driving base 81. An end of a screw member 89 on the front end of the driving shaft 86 is secured into a screwed hole (not shown) through a nut N. The screw member 89 has a male thread on each of the opposite ends. The front end of the screw member 89 is secured in a screwed hole (not shown) in the rear end surface of the driving and pressing block 73. Accordingly, the driving mechanism 80 can move the driving and pressing block 73 forward and backward by turning the lever 84.

An inspection unit 90 for determining the turned position of the lever 84 is provided in the driving mechanism 80. The inspection unit 90 includes an inspection part 91 mounted on the base 60 and a dog 92 mounted on the lever 84. The inspection part 91 includes a substantially rectangular parallelepiped stay 91*a* that may be constructed of any suitable material such as, for example, a synthetic resin material. The stay 91*a* is provided in the interior thereof with an inspection probe 91*b*. The inspection probe 91*b* is secured to the stay 91*a* so that the top surface of the probe 91*b* is aligned with the top surface of the stay 91*a* and serves as a switch adapted to be pushed downward. The inspection probe 91*b* is connected through a lead wire 91*c* to a connector 91*d*, which is connected to a well-known inspection device. The dog 92 includes a joining plate 92*a* and may be constructed of any suitable material such as, for example, metallic material. An end of the coupling plate 92*a* is bent to clamp the lever 84 and to secure it to the plate 92*a* by a bolt 92*b* inserted laterally. The other end of the coupling plate 92*a* is inserted into a pushing block 92*c* and secured to it by a bolt 92*d* inserted from the rear side. The pushing block 92*c* has a pushing projection 92*e*. The pushing projection 92*e* is provided at a position corresponding to a relative position between the inspection probe 91*b* and the lever 84 when the lever 84 is turned to the down position. Thus, when the lever 84 is turned to the down position, the pushing projection 92*e* pushes the inspection probe 91*b*.

The temporarily assembled unit of the terminal assembly 1 is guided into the receiving space 74 of the terminal-joining apparatus 50 constructed above along a longitudinal direction of the respective barrel portions 11, 21, 31, 41.

Figure 6A:
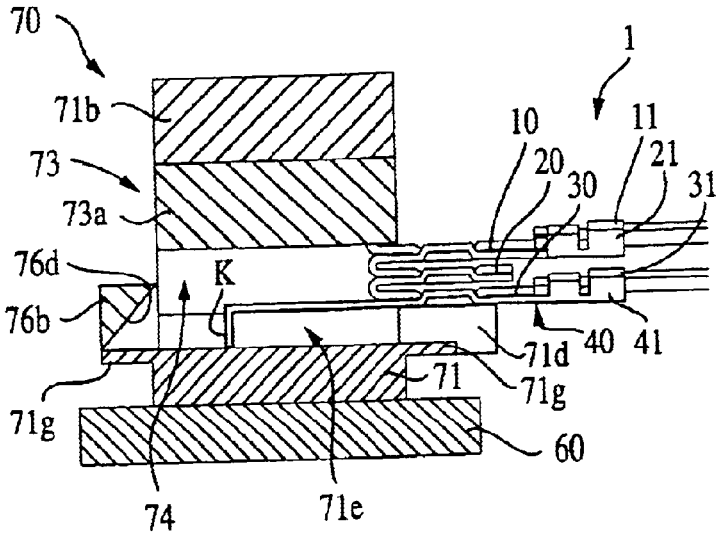
FIG. 6A is a front sectional view of the terminal-joining apparatus shown in FIG. 4, illustrating a temporarily assembled unit of the terminal assembly in a position immediately after starting to insert the unit into the apparatus.
Figure 7A:
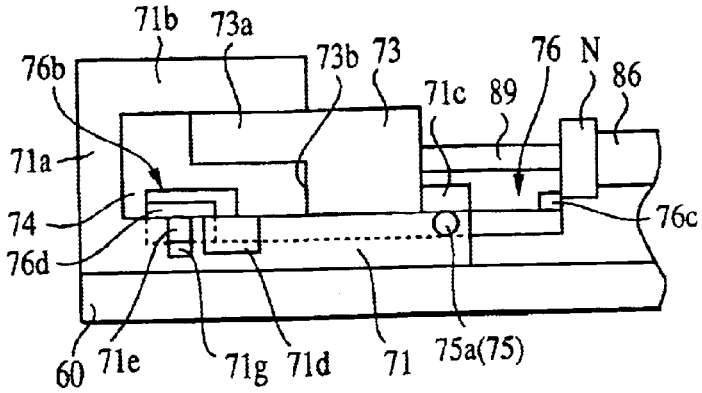
FIG. 7A is a side elevation view of the terminal-joining apparatus shown in FIG. 4 illustrating the lock member in a position before inserting the temporarily assembled unit of the terminal assembly into the terminal-joining apparatus.

Referring now to FIG. 6A, the temporarily assembled unit of the terminal assembly 1 is guided into the receiving space 74 by guiding the bent portion K into the guiding groove 71*e* with the unit being positioned with respect to a longitudinal direction. While the bottom surface of the unit of the terminal assembly 1 (the bottom surface of the ground terminal 40) slides on the top surface of the inspecting portion 71*d*, the unit is guided into the receiving space 74. Referring to FIG. 7A, in the front end of the lock member 76, the lock-releasing portion 76*b* is disposed on the groove tongue 71*g* while in the rear end of the lock member 76, the lock-supporting portion 76*c* is disposed in front of the nut N. That is, the driving shaft 86 is restrained from driving or the lever 84 is restrained from turning.

Figure 6B:
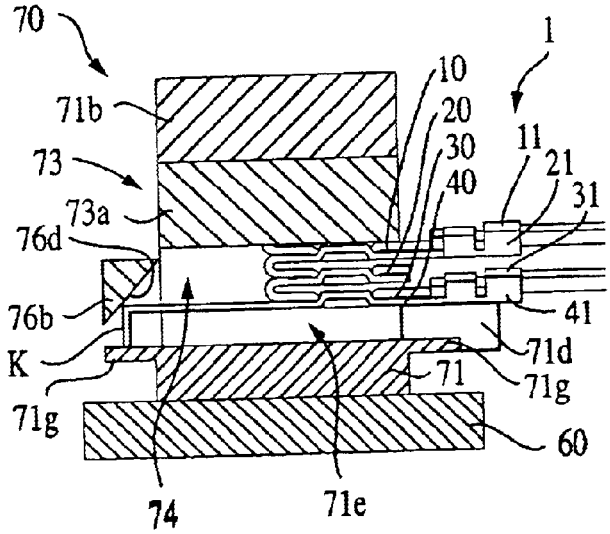
FIG. 6B is a front sectional view of the terminal-joining apparatus shown in FIG. 4, illustrating the temporarily assembled unit of the terminal assembly in a position immediately after starting to actuate a lock-releasing portion.

Referring to FIG. 6B, when the temporarily assembled unit of the terminal assembly 1 is further advanced into the receiving space 74, the bent portion K reaches the groove tongue 71*g*. When the bent portion K comes into contact with the releasing surface 76*d* of the lock-releasing portion 76*b*, the lock-releasing portion 76*b* is pushed up along the releasing surface 76*d*.

Figure 6C:
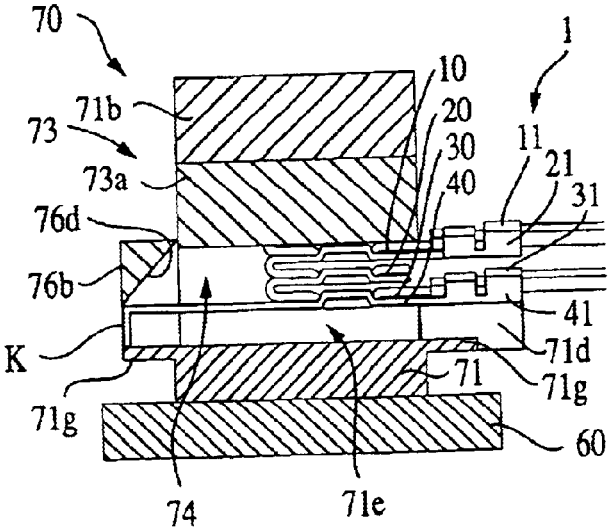
FIG. 6C is a front sectional-view of the terminal-joining apparatus shown in FIG. 4, illustrating a temporarily assembled unit of the terminal assembly in a position in which the unit is disposed in the apparatus after the lock-releasing portion has already been actuated.
Figure 7B:
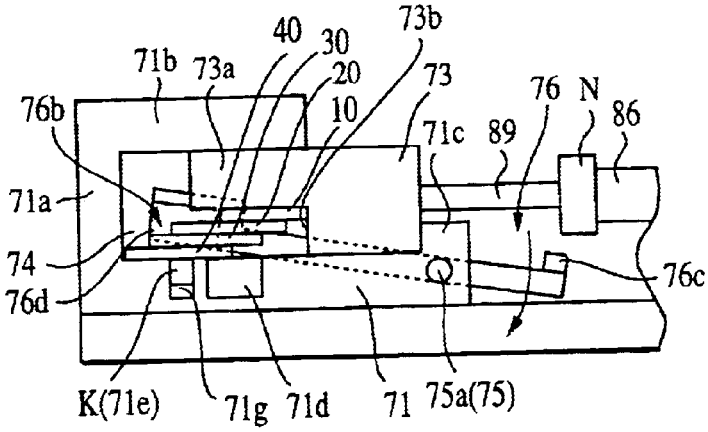
FIG. 7B is a side elevation view of the terminal-joining apparatus shown in FIG. 4 illustrating the lock member in a position after inserting the unit into the terminal-joining apparatus.

Referring to FIG. 6C, when the temporarily assembled unit of the terminal assembly 1 is still further advanced into the receiving space 74, the lock-releasing portion 76*b* rides onto the upper part of the bent portion K (the top surface of the ground terminal 40). Under this condition, the respective ground terminals in the temporarily assembled unit of the terminal assembly 1 are completely inserted in the receiving space 74. By referring to FIG. 7B, when the lock-releasing portion 76*b* on the front end of the lock member 76 is pushed up, the lock-supporting portion 76*b* on the rear end of the lock member 76 is moved down by rotation of the member 76 about the fixed axle 75. Consequently, since the lock-supporting portion 76*b* is not disposed in front of the nut N, the lever is released from being locked.

Figure 7C:
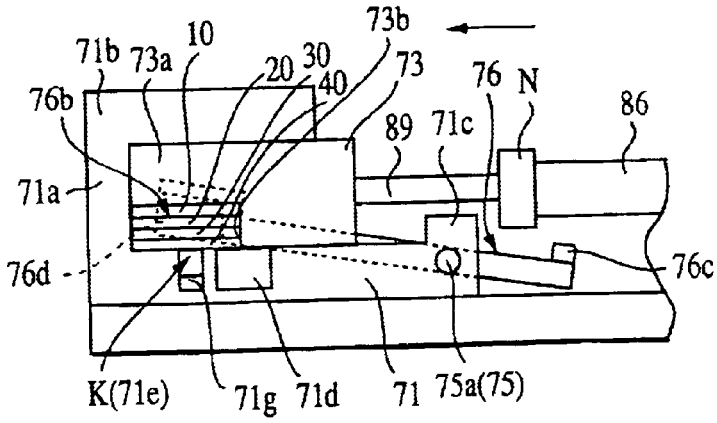
FIG. 7C is a side elevation view of the terminal-joining apparatus shown in FIG. 4 illustrating the lock member in a position after turning a lever.

Referring to FIG. 7C, when the lever 84 is turned, the driving and pressing block 73 is moved forward. In association with movement of the driving and pressing block 73, the pressing surface 73 is driven forward, thereby pressing the temporarily assembled unit of the terminal assembly 1 between the pressing surface 73*b* and the stop wall 71*a* to permanently assemble the unit. At this time, the pushing projection 92*e* of the pushing block 92*c* (see FIG. 4) pushes the inspecting probe 91*d* at the down position of the lever 84 where the temporarily assembled unit of the terminal assembly 1 is permanently assembled. The inspecting device connected to the inspecting probe 91*b* signals the completion of the assembling operation to an operator of the device.

A process of guiding into the terminal-joining apparatus 50 a temporarily assembled unit of the terminal assembly 2 that is not properly assembled, as shown in FIG. 3, will be described below.

Figure 8A:
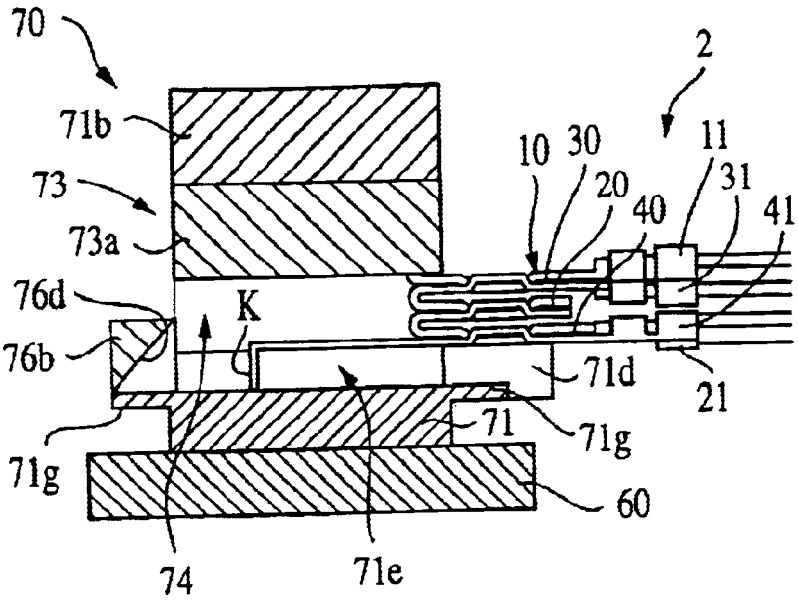
FIG. 8A is a front sectional view of the terminal-joining apparatus shown in FIG. 4, illustrating a position immediately after starting to insert the unit into the terminal-joining apparatus.

Referring to FIG. 8A, the temporarily assembled unit of the terminal assembly 2, as described above, has a structure in which the ground terminals 20 and 30 are inverted from the regular assembling positions (see FIG. 3). When the bent portion K of the temporarily assembled unit of the terminal assembly 2 is guided into the guiding groove 71*e*, the unit is inserted into the receiving space 74 with the unit being positioned with respect to a longitudinal direction. Under this condition, while the bottom surface of the unit of the terminal assembly 2 (the bottom surface of the ground terminal 40) slides on the top surface of the inspecting portion 71*d*, the unit is guided into the receiving space 74.

Figure 8B:
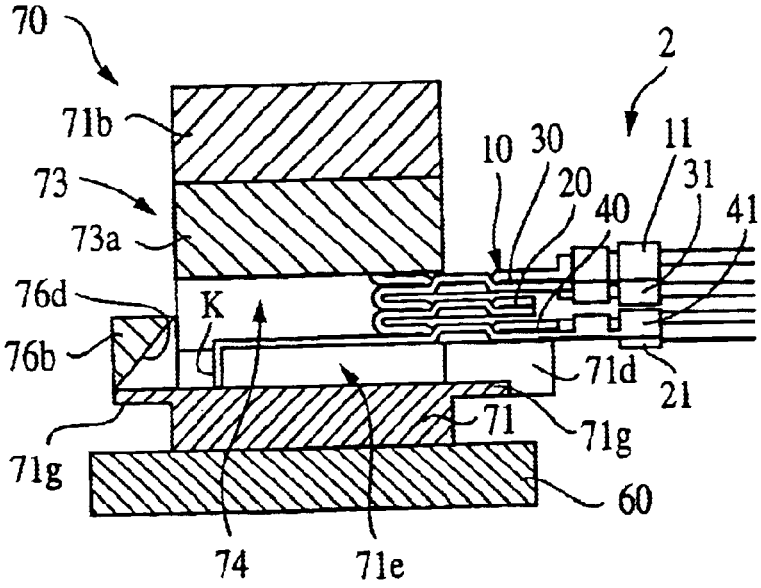
FIG. 8B is a front sectional view of the terminal-joining apparatus shown in FIG. 4, illustrating a position in which the unit cannot be inserted into the terminal-joining apparatus.

Referring to FIG. 8B, when the temporarily assembled unit of the terminal assembly 2 is further advanced into the receiving space 74, the barrel portion 21 of the ground terminal 20 comes into contact with the inspecting portion 71*d*. Under this condition, it is impossible to advance the temporarily assembled unit of the terminal assembly 2 into the receiving space 74 whereby the bent portion K cannot push up the releasing surface 76*d* of the lock-releasing portion 76*b*. Accordingly, the temporarily assembled unit of the terminal assembly 2 cannot release the lever from locking and thus the unit is not permanently assembled.

Since the terminal-joining apparatus 50 constructed above includes the inspecting portion 71*d*, it is possible to guide into the receiving space 74 the temporarily assembled unit of the terminal assembly 1 under the regularly assembled condition. When the guided unit of the terminal assembly 1 pushes up the releasing surface 76*b*, the lever 84 is released from locking. The temporarily assembled unit of the terminal assembly 1 is pressed between the pressing surface 73*b* and the stop wall 71*a* by turning the lever 84 to permanently join the unit.

Accordingly, the terminal-joining apparatus 50 can solve the problem in which a temporarily assembled unit (a terminal assembly 2) having the ground terminals 20 and 30 inverted with respect to a regular position is permanently assembled. It is possible to permanently assemble the respective ground terminals 10, 20, 30, 40 in a single step in comparison with two steps in the prior art.

Figure 9:
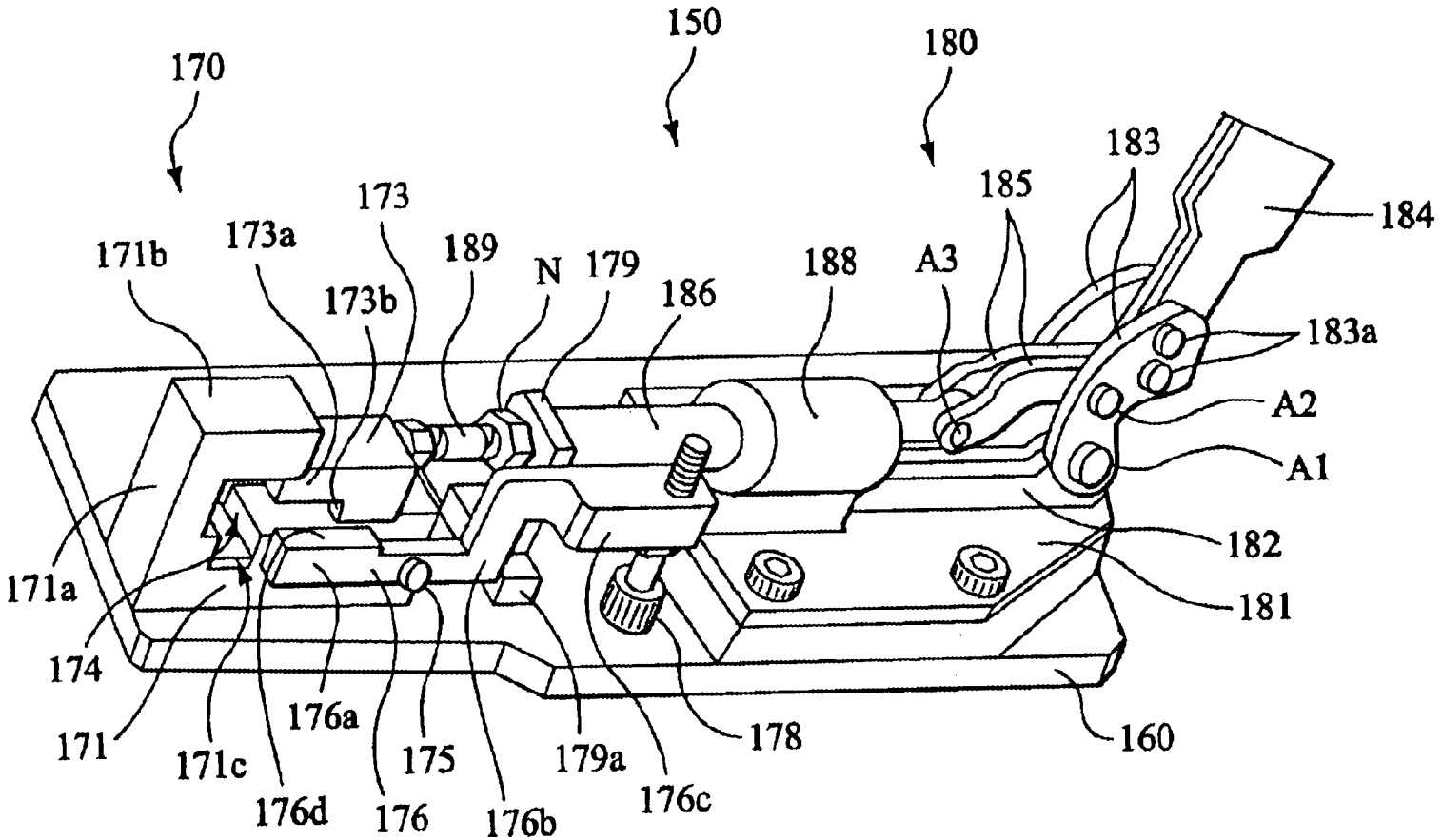
FIG. 9 is a perspective view of a second embodiment of an apparatus for joining terminals in accordance with the present invention.

FIG. 9 is a perspective view of a second embodiment of a terminal-joining apparatus 150 in accordance with the present invention. The terminal-joining apparatus 150 includes a base 160. The base 160 may be constructed of any suitable material such as, for example, metallic material, and is formed into a rectangular parallelepiped member. The base 160 is provided on an end with a holder 170 that holds a temporarily assembled unit of the terminal assembly 1 and on the other end with a driving mechanism 180. For convenience of explanation, the end of the base 160, on which the holder 170 is provided, is hereinafter referred to as the front side and the surface of the base 160, on which the holder 170 is mounted, is hereinafter referred to as the upper side in the thickness direction of the base 160.

The holder 170 includes a planar holder base 171, which may be constructed of any suitable material such as, for example, metallic material. The holder base comprises a stop wall 171*a* that stands upright on the front end and serves as one of a pair of dies, and a top wall 171*b* that extends horizontally from the upper end of the stop wall 171*a* so as to be spaced away from the holder base 171. The stop wall 171*a* and top wall 171*b* define a containing space in which a driving and pressing block 173 is slidably disposed and serves as the other of the pair of dies. The driving and pressing block 173 is formed into a substantially rectangular parallelepiped member. The driving and pressing block 173 is provided on the front end thereof with a projection 173*a* that projects forward. The driving and pressing block 173 is also provided on the front end surface with a non-projecting portion having a pressing surface 173*b*. The driving and pressing block 173 is accommodated in the containing space with the pressing block 173 contacting the holder base 171 and top wall 171*b*. The pressing block 173 can be driven toward and away from the stop wall 171*a*. Thus, when the driving and pressing block 173 is accommodated in the containing space, a receiving space 174 is defined by the pressing surface 173*b*, holder base 171, projecting portion 173*a*, and stop wall 171*a*. The height of the receiving space 174 is set to be substantially the same as a thickness of the temporarily assembled unit of the terminal assembly 1. The holder base 171 is provided with a guiding groove 171*c* for guiding the bent portion K of the terminal assembly 1.

The holder base 171 supports a fixing axle 175 forcedly inserted into a supporting hole at a rear portion thereof. The fixing axle 175 may be constructed of any suitable material such as, for example, metallic material, and pivotally supports a lock member 176. The lock member 176 is formed into an extended bar shaped member and may be constructed of any suitable material such as, for example, metallic material. The lock member 176 is provided on the front end thereof with a lock-releasing portion 176*a*, in a middle portion thereof with a lock-supporting portion 176*b*, and on the rear end thereof with an adjustment portion 176*c*. The lock-releasing portion 176*a* is provided with a releasing surface 176*d*. The lock-supporting portion 176*b* is provided with a lower edge 176*e*. An adjustment screw 178 passes through a screw hole in adjustment portion 176*c*, and permits adjustment of the minimum distance between the bottom surface of adjustment portion 176*c* and the top surface of base 160. In other words, contact between the bottom of adjustment screw 178 and the top surface of base 160 prevents further pivoting of lock member 176. This, in turn, controls the maximum to which lock-releasing portion 176*a* may extend upwardly into receiving space 174.

The driving mechanism 180 includes a driving base 181. The driving base 181 is provided on the rear end thereof with a pair of supporting portions 182 standing on the driving base 181. An axle A1 rotatably supports a joining plate 183 on each supporting portion 182. A lever 184 is secured to and between the joining plates 183 by bolts 183*a* while a pair of movable plates 185 are rotatably supported between the joining plates 183 by an axle A2. A driving shaft 186 is rotatably supported on and between the movable plates 185 by an axle A3. The driving shaft 186 is slidably inserted into a guiding hole 188 in the front end of the driving base 181. An end of a screw member 189 on the front end of the driving shaft 186 is secured into a screwed hole (not shown) through a nut N. The screw member 189 has a male thread on each of the opposite ends. The front end of the screw member 189 is secured in a screwed hole (not shown) in the rear end surface of the driving and pressing block 173. Accordingly, the driving mechanism 180 can move the driving and pressing block 173 forward and backward by turning the lever 184.

Figure 10A:
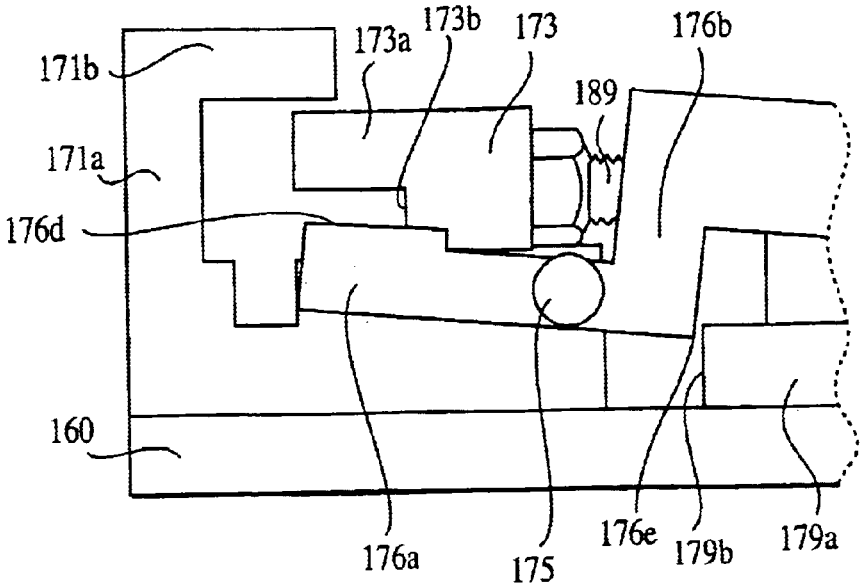
FIG. 10A is a side elevation view of the terminal-joining apparatus shown in FIG. 9 illustrating the position of the lock member when an improperly stacked temporarily assembled unit is inserted into the terminal-joining apparatus.
Figure 10B:
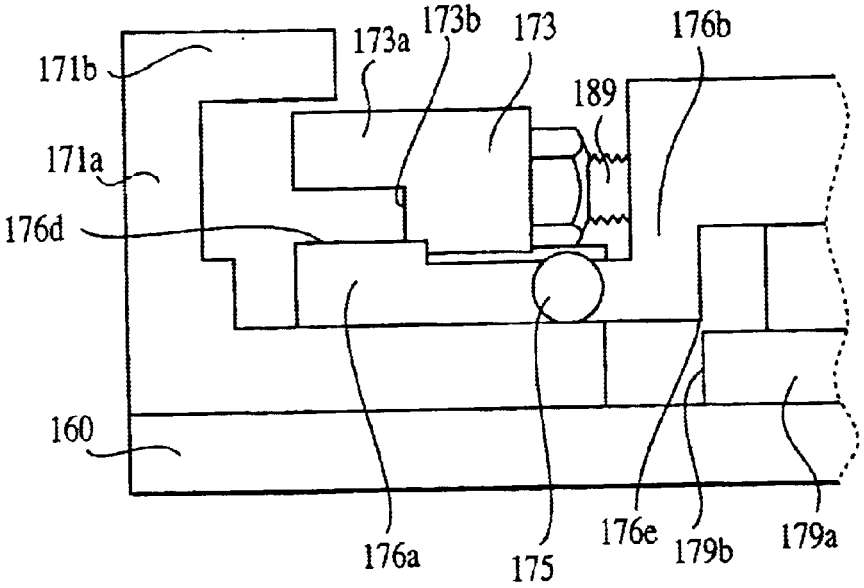
FIG. 10B is a side elevation view of the terminal-joining apparatus shown in FIG. 9 illustrating the position of the lock member when a properly stacked temporarily assembled unit is inserted into the terminal-joining apparatus.

The nut N also secures a locking arm 179 onto drive shaft 186. Locking arm 179 includes a lower portion 179*a* having a front engaging surface 179*b*. As shown in FIG. 10A, when lock member 176 is pivoted to a locking position, the lower edge 176*e* of lock-supporting portion 176*b* prevents forward movement of locking arm 179 by contacting the front engaging surface 179*b* of lower portion 179*a*. In this condition, movement of pressing block 173 toward holder 170 is prevented. As shown in FIG. 10B, when lock member 176 is pivoted to a position in which the lower edge 176*e* of lock-supporting portion 176*b* is located above the front engaging surface 179*b* of lower portion 179*a* of locking arm 179, pressing block 173 can be moved toward holder 170.

When a proper temporarily assembled unit of a terminal assembly 1 is inserted into receiving space 174, the barrel portions of the properly stacked ground terminals engage releasing surface 176*d* of lock member 176. The releasing suface 176*d* is thereby pushed downwardly, and lock member 176 is pivoted to the position shown in FIG. 10B, so that pressing block 173 can be moved toward holder 170 to press the temporarily assembled terminal assembly in receiving space 174. When an improper temporarily assembled unit of a terminal assembly 2 is inserted into receiving space 174, the barrel portions of the improperly stacked ground terminals do not engage releasing surface 176*d*. Therefore, the releasing suface 176*d* is not pushed downwardly, and lock member 176 remains in the position shown in FIG. 10A, so that pressing block 173 is prevented from moving toward holder 170.

Accordingly, the terminal-joining apparatus 150 can solve the problem in which a temporarily assembled unit (a terminal assembly 2) having the ground terminals 20 and 30 inverted with respect to a regular position is permanently assembled. It is possible to permanently assemble the respective ground terminals 10, 20, 30, 40 in a single step in comparison with two steps in the prior art.

It should also be understood that, although not shown in FIG. 9, an inspection unit, such as 90 of the first embodiment, could also be provided in the second embodiment.

From the above description of the invention, one skilled in the art will perceive improvements, changes and modifications. Such improvements, changes and modifications within the skill of the art are intended to be covered by the appended claims.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Patent Application No. 2002-033803 filed on Feb. 12, 2002, which is herein expressly incorporated by reference in its entirety.

What is claimed is:

1. An apparatus for joining a plurality of ground terminals, wherein each of said ground terminals includes a planar connecting portion and a barrel portion extending from said connecting portion, said connecting portions are displaced from and stacked on each other to form a temporarily assembled unit, said apparatus comprising:

a receiving space for guiding a temporarily assembled unit along a longitudinal direction of said barrel portions;

a first of a pair of dies defining said receiving space, said first die receiving a side section of said temporarily assembled unit;

a second of said pair of dies defining said receiving space, said second die permanently joining said temporarily assembled ground terminals by pressing said temporarily assembled unit in cooperation with said first die;

a driving mechanism that drives said pair of dies between an open position wherein said temporarily assembled unit can enter a space between said dies and a pressing position wherein said unit is pressed, wherein said unit is permanently joined by driving said ground terminals of said unit in directions perpendicular to the axes of said barrel portions;

a locking mechanism that restrains said driving mechanism in said open position; and a lock-releasing mechanism that releases said locking mechanism only when said temporarily assembled unit guided in said receiving space includes said ground terminals stacked in a predetermined stacking configuration.

2. The apparatus for joining a plurality of ground terminals according to claim 1, wherein said lock-releasing mechanism prevents release of said locking mechanism when said temporarily assembled unit guided in said receiving space includes said ground terminals stacked in a stacking configuration other than said predetermined stacking configuration.

3. The apparatus for joining a plurality of ground terminals according to claim 1, said driving mechanism comprising:

a driving base;

a lever rotatably mounted on said driving base;

a guide tube provided on said driving base;

a drive shaft secured to said lever and slidably moveable in said guide tube; and a screw member secured to said drive shaft and to said second die such that upon rotation of said lever said drive shaft slides within said guide tube, driving said second die toward said first die and permanently joining said temporarily assembled unit.

4. The apparatus for joining a plurality of ground terminals according to claim 3, said apparatus further comprising:

an inspection unit including an inspection probe provided on said driving base and a pushing projection provided on said lever, wherein when said lever is fully rotated to a down position and said second die is fully driven toward said first die, said inspection unit signals an operator that said temporarily assembled unit is permanently joined.

5. The apparatus for joining a plurality of ground terminals according to claim 3, said locking mechanism comprising:

a nut provided on said screw member; and a locking member rotatably mounted on said first die, said locking member having an elongated configuration and including a lock releasing portion provided at a front end thereof and a lock supporting portion provided at a rear end thereof and cooperating with said nut;

said lock releasing mechanism comprising a guide groove provided in said receiving space, said guide groove configured to receive a bent connecting portion of the lowermost ground terminal;

wherein when a temporarily assembled unit is guided along the longitudinal direction of said barrel portions into said receiving space, said bent connecting portion is guided along said guide groove to a position in which said bent connecting portion contacts said lock releasing portion and releases said lock mechanism by rotating said locking member until said lock supporting portion is released from said nut freeing said driving mechanism.

6. The apparatus for joining a plurality of ground terminals according to claim 5, wherein when a temporarily assembled unit that includes said ground terminals stacked in a stacking configuration other than said predetermined stacking configuration is guided along the longitudinal direction of said barrel portions into said receiving space, at least one of the barrel portions prevents said bent connecting portion from being guided along said guide groove to the position in which the bent connecting portion contacts said lock releasing portion and said locking mechanism remains locked, preventing permanent joining of the temporarily assembled unit.

7. The apparatus for joining a plurality of ground terminals according to claim 3, said locking mechanism comprising:

a locking arm provided on said drive shaft; and a locking member rotatably mounted on said first die, said locking member having a elongated configuration and including a lock releasing portion provided at a front end thereof and a lock supporting portion provided at a middle portion thereof and cooperating with said locking arm;

wherein when a temporarily assembled unit is inserted into said receiving space it engages said lock releasing portion, whereby said locking member is rotated until said lock supporting portion is released from said locking arm freeing said driving mechanism.

8. The apparatus for joining a plurality of ground terminals according to claim 7, wherein when a temporarily assembled unit that includes said ground terminals stacked in a stacking configuration other than said predetermined stacking configuration is inserted into said receiving space, said locking member is not rotated and said lock supporting portion engages said locking arm so that said locking mechanism remains locked, preventing permanent joining of the temporarily assembled unit.

9. The apparatus for joining a plurality of ground terminals according to claim 7, wherein said barrel portions of a temporarily assembled unit inserted into said receiving space engage said lock releasing portion for rotating said locking member.

10. The apparatus for joining a plurality of ground terminals according to claim 7, said locking member further including an adjustment portion provided at a rear end thereof for limiting rotation of said locking member in order to adjust a position of said lock releasing portion.

* * * * *